US006422208B1

(12) United States Patent
Ertem et al.

(10) Patent No.: US 6,422,208 B1
(45) Date of Patent: Jul. 23, 2002

(54) FUEL INJECTION VALVE FOR INTERNAL COMBUSTION ENGINES

(75) Inventors: Yalcin Ertem, Bursa; Ergün Filiz, Cekirge/Bursa; Güngör Yurtseven, Mudanya/Bursa, all of (TR); Heinz Stutzenberger, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/622,142

(22) PCT Filed: Oct. 21, 1999

(86) PCT No.: PCT/DE99/03371

§ 371 (c)(1),
(2), (4) Date: Nov. 22, 2000

(87) PCT Pub. No.: WO00/36294

PCT Pub. Date: Jun. 22, 2000

(30) Foreign Application Priority Data

Dec. 11, 1998 (DE) ..... 198 57 244

(51) Int. Cl.[7] ..... F02M 37/04
(52) U.S. Cl. ..... 123/467; 123/496
(58) Field of Search ..... 123/467, 299, 123/300, 496; 239/533.12, 408, 85, 95

(56) References Cited

U.S. PATENT DOCUMENTS 4,417,694 A * 11/1983 Claxton et al. ..... 239/533.12
4,987,887 A 1/1991 Kelly
5,299,919 A * 4/1994 Paul et al. ..... 417/387
5,647,536 A * 7/1997 Yen et al. ..... 239/90
5,711,277 A * 1/1998 Fuseya ..... 123/496
5,769,319 A 6/1998 Yen et al.
5,904,299 A * 5/1999 Hans et al. ..... 239/408
6,062,533 A * 5/2000 Kappel et al. ..... 251/57

* cited by examiner

*Primary Examiner*—Carl S. Miller
(74) *Attorney, Agent, or Firm*—Kenyon & Kenyon

(57) ABSTRACT

A fuel injector for an internal combustion engine, having a valve member which is axially displaceable in a guide bore of a valve body, has two guide areas with which it is displaceably guided in the guide bore, a first upper guide area being provided on the send of the valve member facing away from the combustion chamber and a second lower guide area being provided in an area of the valve member near the combustion chamber, a lower guide area separating an annular clearance which is formed between the valve member shaft and the wall of the guide bore and is connected to a high-pressure fuel inlet channel is separated from a lower pressure space opening onto the valve seat face when the fuel injector is closed, and opening this connection during the opening stroke movement of the valve member, and having a connecting throttle cross section between the annular clearance and the lower pressure space. This throttle cross section is designed as a throttlebore.

11 Claims, 2 Drawing Sheets

FUEL INJECTION VALVE FOR INTERNAL COMBUSTION ENGINES

BACKGROUND OF THE INVENTION

The present invention relates to a fuel injector for internal combustion engines In a fuel filter described in U.S. Pat. No. 4,987,887, a piston-like valve member is axially displaceable in a guide bore of a valve body. The valve member has a conical valve sealing face on its lower end facing the combustion chamber with which it cooperates with a stationary valve seat face on the closed end of the guide bore. With the known a fuel injector, two injection orifices arranged downstream from the valve seat face opening from the closed end of the guide bore and opening into the combustion chamber of the internal combustion engine. Fuel flow to these injection orifices is controlled by the sealing cross section between the valve seat face and the valve sealing face. The valve member of the known fuel injector has two guide areas with which it is displaceably guided along the wall of the guide bore. A first upper guide area is provided on the end of the valve member which faces away from the combustion chamber and extends above a fuel pressure space that is formed by an enlargement in the cross section of the guide bore and opens into the one high-pressure fuel inlet channel. In addition to the function of secure guidance of the valve member, the upper guide area assumes the function of sealing the pressure space with respect to a spring space accommodating a valve spring acting on the valve member in the closing direction. In addition to this first upper guide area, the valve member has a second lower guide area in an area designed as a ring collar facing the combustion chamber with which the valve member cooperates with a reduced diameter of the guide bore. The lower guide area is designed as a ring collar, so that an annular clearance formed by the guide bore between the valve member and the wall of the guide bore starting from the pressure space is separated from a lower pressure space opening onto the valve seat face when the fuel injector is closed. During the upward opening motion of the valve member, the ring collar of the lower guide area of the valve member emerges from the overlap with the reduced diameter of the guide bore and thus opens an unthrottled flow cross section between the annular clearance and the lower pressure space.

To supply fuel to the lower pressure space, a throttle flow cross section is provided between the annular clearance and the lower pressure space through which fuel can flow into the lower pressure space when the fuel injector is closed, i.e., when the valve member is in contact with the valve seat. In the known fuel injector, this throttle cross section is provided as an annular throttle clearance between the ring collar of the lower guide area and the reduced diameter of the guide bore.

However, the disadvantage of this design of the connecting throttle cross section between the annular clearance and the lower pressure space in the known fuel injection valve for internal combustion engines is that it is difficult to set the correct throttle cross section reproducibly on various fuel injectors because of surface tolerances in the ring collar and in the wall of the guide bore. This method of producing a correct throttle gap is especially demanding with regard to manufacturing precision, which can thus be achieved only at great expense and great effort. However, a precise setting of the throttle cross section is extremely important from the standpoint of correct functioning of the fuel injector, in particular the pilot injection setting, so the possibility of setting the cross section on the basis of the annular throttle clearance between the guide collar and the wall of the guide bore is not sufficient.

SUMMARY OF THE INVENTION

The fuel injector for internal combustion engines Patent claim 1, has the advantage over the related art that the connecting throttle cross section between the annular clearance and the lower pressure space on the fuel injector can be established easily and reproducibly with a high precision. This is achieved through the design of the connecting throttle cross section according to the present invention as a throttle bore passing through the valve member at an oblique angle, the inlet orifice of the throttle bore being arranged in the area of the annular clearance, and the outlet orifice is arranged in the area of the lower pressure space.

Such a throttle bore can be produced with a high precision and simple means in terms of the manufacturing technology, and even a very small variation range in mass production can be further reduced. It is especially advantageous that contrary to the related art, such a throttle bore is not dependent upon any tolerance in the fit between the valve member and the geometry of the guide bore. The throttle bore in the valve member may have the same throttle cross section over its length, but it is also possible for the throttle cross section to be designed in two or more stages, in which case the smallest bore diameter determines the throttle flow cross section. This smallest throttle bore cross section may then be provided at the inlet of the throttle bore, in the middle area or at the outlet of the throttle bore (as shown in the embodiment). The design of the throttle bore as a two-stage or multi-stage bore has the advantage that good through flow can be achieved with a sufficient throttle effect, where the desired throttle effect can be achieved for each type of fuel injector with a simple construction on the basis of the diameter difference between the large throttle diameter and the smallest throttle diameter of the bore and the respective bore lengths between the larger part of the bore and the throttle cross section.

It is thus possible with the fuel injector according to the present invention to accurately and reproducibly adjust the throttle cross section between the annular clearance and the lower pressure space, which is important in shaping the injection pattern at the injector, with a simple construction.

Another advantage of the fuel injector according to the present invention is achieved due to the fact that an annular groove is provided at the transition between the ring collar forming the lower guide area and an adjacent area of the valve member which has a reduced cross section. This annular groove has the advantage that the lower edge of the ring collar which forms a control edge is machined so as to have a sharper edge, so that precise control can be achieved in the interaction with the corresponding collar of the guide bore.

Another advantage of the fuel injector according to the present invention is achieved by providing recesses on the valve member in the area of the lower pressure space, these recesses, preferably designed as polished sections, permitting a better unhindered flow from the annular clearance into the lower pressure space after the ring collar emerges from the bore shoulder face, so that the fuel which is under a high pressure can flow over out of the fuel inlet channel to the injection orifices as uniformly as possible through the annular clearance and the lower pressure space.

DETAILED DESCRIPTION

Figure 1:
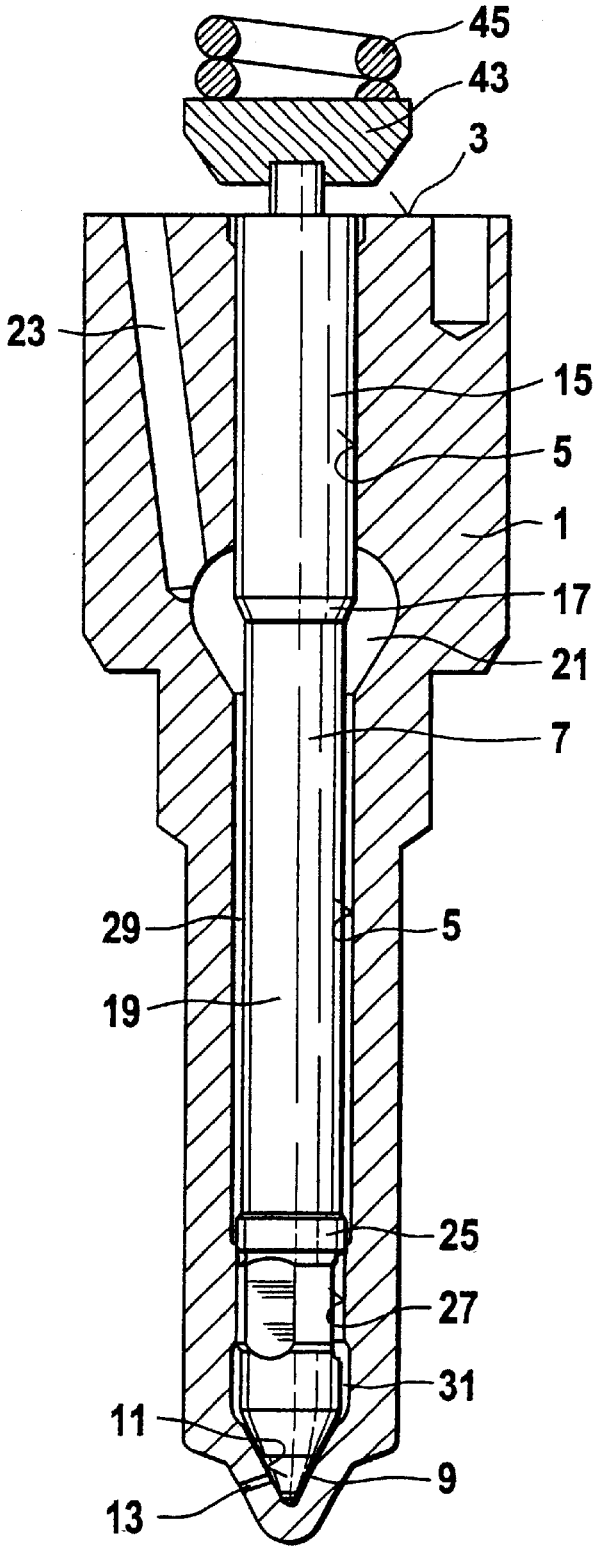
FIG. 1 shows a longitudinal section through the valve body and the valve member guided in it in a first embodiment of the fuel injector.

The embodiment of the fuel injector according to the present invention for internal combustion engines, as illustrated in a simplified sectional view in FIG. 1, has a valve body 1 which projects at its lower free end into the combustion chamber of the internal combustion engine to be supplied with fuel in a manner not shown in detail here, and the valve body is also braced with its upper end face turned away from the combustion chamber against a valve holding body (not shown in detail here). Valve body 1 here has a guide bore 5 designed as an axial blind nole starting from its upper end face 3. A piston-like valve member 7 which can be displaced axially in this guide bore 5 has a conical valve sealing face 9 on its lower end toward the combustion chamber which works together with a stationary valve seat face 1 formed on the closed end of the guide bore 5. An injection orifice 13 opening into the combustion chamber of the internal combustion engine to be supplied with fuel leads from this valve seat face 11 downstream from the sealing cross section formed the line of contact between valve seat face 11 and valve sealing face 9. This embodiment has only one injection orifice, but as an alternative, it is also possible to provide a plurality of injection orifices, in which case as an alternative, they can also lead from the blind hole of guide bore 5 formed beneath valve member 7.

Piston-like valve member 7 has two guide areas with which it can be displaced on the wall of guide bore 5. A first upper guide area 15 is provided on the end of valve member 7 which faces away from the combustion chamber and is guided in an upper area of guide bore 5 facing away from the combustion chamber. Upper guide area 15 of valve member 7 develops into a valve member shaft part 19 with a reduced diameter by way of a shoulder forming a pressure shoulder 17. Pressure shoulder 17 is arranged in an upper pressure space 21 formed by an enlarged cross section of guide bore 5 and opening into high pressure fuel inlet channel 23. This high-pressure fuel inlet channel 23 is connected in a manner not shown in detail here to a high-pressure injection line which also leads from a high-pressure fuel pump through which fuel is supplied from a supply tank under high pressure to the individual fuel injectors.

Figure 2:
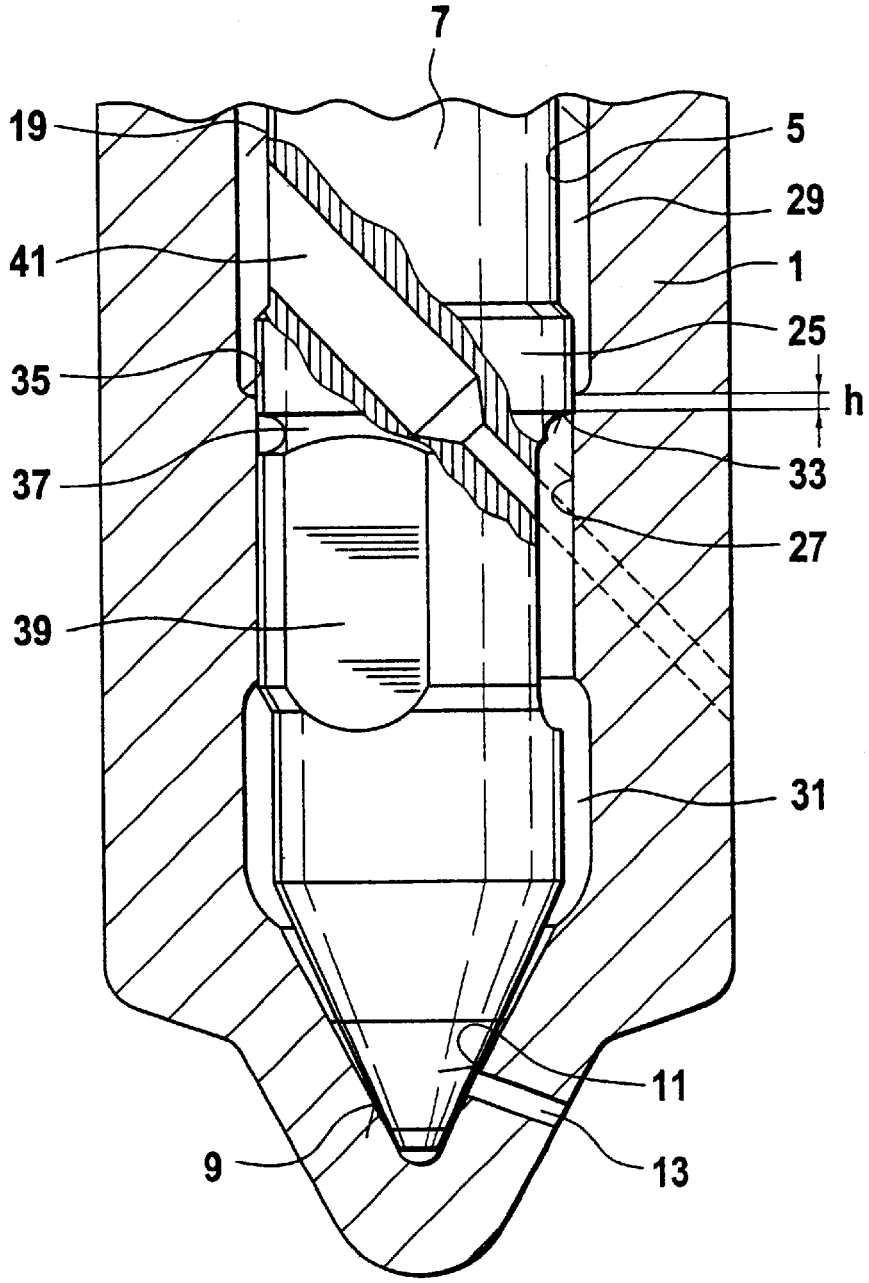
FIG. 2 shows an enlarged detail from FIG. 1 in the area of the valve body which faces the combustion chamber and shows the geometry of the valve member guided in the valve body on its end facing the combustion chamber.

A second lower guide area on the end of valve member 7 close to the combustion chamber is designed as ring collar 25 which works together at its cylindrical outside wall surface with the wall of a bore shoulder 27 of guide bore 5. Ring collar 25 of valve member 7 forming the second lower guide area separates an annular clearance 29 formed between valve member shaft part 19 and the wall of guide bore 5 from a lower pressure space 31 arranged downstream beneath ring collar 25 and opening onto valve seat face 11 when the fuel injector is closed As shown in an enlarged diagram in FIG. 2, ring collar 25 forms a control edge 33 with its lower bordering edge facing the combustion chamber with which it works together at a bore shoulder edge 35 of bore shoulder 27 facing away from the combustion chamber. Control edge 33 and bore shoulder edge 35 are arranged so that control edge 33 on ring collar 25 of valve member 7 passes over upper bore shoulder edge 35 in its upward opening motion, thus exposing a flow cross section between annular clearance 29 and lower pressure space 31. Valve member 7 has an annular groove 37 for more accurate creation of control edge 33 on ring collar 25 between the transition from ring collar 25 to the valve member shaft in lower pressure space 31. In addition, recesses in the form of planar sections 39 are machined into valve member 7 in the area of lower pressure space 31, further increasing the flow cross section in this area.

In addition, for filling of lower pressure space 31 with fuel when valve member 7 is in contact with valve seat face 11, a throttle bore 41 is provided in valve member 7. Throttle bore 41 here is arranged at an inclination so that its inlet orifice opens into annular clearance 29 and its outlet orifice opens into lower pressure space 31. In addition, throttle bore 41 is designed as a two-stage bore, with the section of bore having the larger diameter opens into annular clearance 29, and the section of bore having the smaller diameter opens into lower pressure space 31. The throttle effect with fuel flowing through can be adjusted easily on the basis of the small throttling diameter and its arrangement within throttle bore 41.

The fuel injector according to the present invention for internal combustion engines operates as described below.

With the fuel injector closed, a valve spring 45 holds valve member 15 with its valve sealing face 9 in contact with valve seat face 11 over a valve plate 43, so that a flow cross section to injection orifice 13 is closed. At the same time, ring collar 25 on valve member 7 is inserted into bore shoulder 27, thus separating lower pressure space 31 from annular clearance 29, which in turn opens into upper pressure space 21. The static pressure of the fuel in high-pressure fuel inlet channel 23, in upper pressure space 21 and in annular clearance 29 is also built up in lower pressure space 31 through throttle bore 41.

High-pressure fuel injection at the injector is induced by supplying fuel under a high pressure from the injection pump through high-pressure fuel inlet channel 23 into upper pressure space 21. Then the high fuel pressure acting on pressure shoulder 17 in the direction of opening displaces valve member 7 against the closing force of valve spring 45 in the direction of the opening stroke. Consequently, valve sealing face 9 lifts up from valve seat 11, exposing the flow cross section to injection orifice 13, so that fuel in lower pressure space 31 is injected through injection orifice 13 into the combustion chamber of the internal combustion engine. Then the fuel pressure in lower pressure space 31 collapses very rapidly, because the injection cross section at injection orifice 13 is designed to be larger than the smallest diameter of throttle bore 41. In this first opening stroke phase of valve member 7, more fuel thus flows out of lower pressure space 31 through injection orifice 13 than can flow into it through throttle bore 41. This results in a pressure gradient on ring collar 25, causing the high fuel pressure available in annular clearance 29 to apply an additional closing force to the cross section transition to ring collar 25. Due to this additional closing pressure, the opening stroke movement of the valve member is decelerated until the high fuel pressure which continues to develop in pressure space 21 is sufficient to overcome this additional closing force and displace valve member 7 upward as far as its opening stroke stop. During this additional opening stroke movement of valve member 7, ring collar 25 emerges from the overlap with bore shoulder 27, thus exposing an unthrottled overflow cross section between annular clearance 29 and lower pressure space 31, so that high-pressure fuel injection is continued at injection orifice 13 of the fuel injector. The time of widening of this connecting cross section is defined by the passage of control edge 33 on ring collar 25 over bore shoulder edge 35. Then the opening time of unthrottled flow between annular clearance 29 and lower pressure space 31 and thus the first opening stroke phase can now be adjusted easily by the design of ring collar 25 and in particular axial distance h between control edge 33 and bore shoulder edge 35. In addition, the injection pattern can also be shaped smoothly on the basis of the throttle cross section of throttle bore 41.

With the emergence of ring collar 25 from the overlap with bore shoulder 27, the fuel injector is then completely open in the usual manner until valve member 7 comes in contact with an opening stroke stop.

The fuel injector is closed in a known manner by interrupting the high-pressure fuel supply into upper pressure space 21, as a result of which the pressure applied to the fuel injector drops back below the required opening pressure, so that valve spring 45 then moves valve member 7 back until it is in contact with valve seat face 11, at which point the pressure buildup described above begins again through throttle bore 41.

It is now possible in a simple manner with the fuel injector according to the present invention to set a two-stage opening stroke characteristic of valve member 7 without having to rely on a second additional valve closing spring.

What is claimed is:

1. A fuel injector for an internal combustion engine, comprising:

a valve body including a guide bore, at least one orifice for injection into a combustion chamber of the internal combustion engine, and a stationary valve seat face;

a valve member that is axially displaceable in the guide bore of the valve body and including a valve sealing face on an end of the valve member near the combustion chamber that works together with the stationary valve seat face, the at least one orifice being supplied with a fuel adjacent downstream to a sealing cross-section between the stationary valve seat face and the valve sealing face, wherein:

the valve member includes a first upper guide area and a second lower guide area with which the valve member can be slidingly guided in the guide bore, the first upper guide area is arranged on an end of the valve member facing away from the combustion chamber, and the second lower guide area is provided in a region of the valve member facing the combustion chamber, the second lower guide area separates an annular clearance from a lower pressure space opening onto the stationary valve seat face when the fuel injector is closed to form a connection, the annular clearance being formed between a shaft of the valve member and a wall of the guide bore and communicating with a high-pressure fuel inlet channel, and the second lower guide area opens the connection during an opening stroke movement of the valve member; and a connecting throttle cross section formed as a throttle bore and arranged between the annular clearance and the lower pressure space within the second lower guide area.

2. The fuel injector according to claim 1, wherein:

the throttle bore is formed as an inclined bore in the valve member and includes an inlet orifice and an outlet orifice, the inlet orifice of the throttle bore opens into the annular clearance above the second lower guide area, and the outlet orifice of the throttle bore opens into the lower pressure space below the second lower guide area.

3. The fuel injector according to claim 1, wherein:

the throttle bore is formed as a stepped bore.

4. The fuel injector according to claim 3, wherein:

the stepped bore includes two different diameters.

5. The fuel injector according to claim 1, wherein:

the second lower guide area on the valve member is formed as a ring collar.

6. The fuel injector according to claim 5, wherein:

an annular groove is arranged at a transition between the ring collar and a portion of the shaft of the valve member projecting into the lower pressure space.

7. The fuel injector according to claim 5, wherein:

the ring collar forms a control edge including a lower edge facing the combustion chamber, so that the control edge cooperates with a bore shoulder formed at a reduction in diameter of the guide bore.

8. The fuel injector according to claim 1, wherein:

a reduction in cross section occurs on the shaft of the valve member in an area of the lower pressure space.

9. The fuel injector according to claim 1, wherein:

the shaft of the valve member includes a recess in an area of the lower pressure space.

10. The fuel injector according to claim 9, wherein:

the recess corresponds to a polished surface section.

11. A fuel injector for an internal combustion engine, comprising:

a valve body including a guide bore, at least one orifice for injection into a combustion chamber of the internal combustion engine, and a stationary valve seat face;

a valve member that is axially displaceable in the guide bore of the valve body and including a valve sealing face on an end of the valve member near the combustion chamber that works together with the stationary valve seat face, the at least one orifice being supplied with a fuel adjacent downstream to a sealing cross-section between the stationary valve seat face and the valve sealing face, wherein:

the valve member includes a first upper guide area and a second lower guide area with which the valve member can be slidingly guided in the guide bore, the first upper guide area is arranged on an end of the valve member facing away from the combustion chamber and having a first cross-sectional area, and the second lower guide area is provided in a region of the valve member facing the combustion chamber and having a second cross-sectional area, wherein the second cross-sectional area is smaller than the first cross-sectional area, the second lower guide area separates an annular clearance from a lower pressure space opening onto the stationary valve seat face when the fuel injector is closed to form a connection, the annular clearance being formed between a shaft of the valve member and a wall of the guide bore and communicating with a high-pressure fuel inlet channel, and the second lower guide area opens the connection during an opening stroke movement of the valve member; and a connecting throttle cross section formed as a throttle bore and arranged between the annular clearance and the lower pressure space within the second lower guide area.

* * * * *